US008519328B2

(12) United States Patent
Giles et al.

(10) Patent No.: US 8,519,328 B2
(45) **Date of Patent: *Aug. 27, 2013**

(54) MASS SPECTROMETER

(75) Inventors: Kevin Giles, Stockport (GB); Martin Green, Bowden (GB); Jason Lee Wildgoose, Stockport (GB); Steven Derek Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/435,877

(22) Filed: Mar. 30, 2012

(65) Prior Publication Data

US 2012/0199734 A1 Aug. 9, 2012

Related U.S. Application Data

(63) Continuation of application No. 11/916,438, filed as application No. PCT/GB2006/002024 on Jun. 5, 2006, now Pat. No. 8,153,960.

(60) Provisional application No. 60/688,003, filed on Jun. 7, 2005.

(30) Foreign Application Priority Data

Jun. 3, 2005 (GB) ..... 0511333.7

(51) Int. Cl.
*H01J 49/26* (2006.01)

(52) U.S. Cl.
USPC ..... 250/282; 250/281; 250/283

(58) Field of Classification Search
USPC ..... 250/281, 282, 283, 286, 287, 288
See application file for complete search history.

(56) References Cited

U.S. PATENT DOCUMENTS

| | | | | |
|---|---|---|---|---|
| 5,689,111 | A | 11/1997 | Dresch et al. | |
| 8,153,960 | B2 * | 4/2012 | Giles et al. | 250/282 |
| 2001/0030284 | A1 * | 10/2001 | Dresch et al. | 250/287 |
| 2002/0100870 | A1 * | 8/2002 | Whitehouse et al. | 250/281 |
| 2008/0067342 | A1 | 3/2008 | Ding | |
| 2008/0248585 | A1 | 10/2008 | Chen et al. | |

FOREIGN PATENT DOCUMENTS

| | | |
|---|---|---|
| EP | 1367633 | 3/2003 |
| GB | 2382919 | 6/2003 |
| GB | 2389227 | 12/2003 |
| GB | 2391697 | 2/2004 |
| JP | 1021871 | 1/1989 |
| JP | 2000516762 | 12/2000 |

* cited by examiner

*Primary Examiner* — Nicole Ippolito
(74) *Attorney, Agent, or Firm* — Diederiks & Whitelaw, PLC

(57) ABSTRACT

An ion guide or ion trap is disclosed having an entrance electrode and an exit electrode. The potential of the exit electrode is periodically dropped for a relatively short period of time allowing some ions to escape from the ion guide or ion trap via an aperture in the exit electrode. The period of time that the potential of the exit electrode is dropped for is progressively increased and ions emerge from the ion guide or ion trap in a mass to charge ratio dependent manner. The ion guide or ion trap may be operated as a mass separator or low resolution mass analyzer.

23 Claims, 10 Drawing Sheets

MASS SPECTROMETER

CROSS REFERENCE TO RELATED APPLICATIONS

This application is a continuation of U.S. patent application Ser. No. 11/916,438 filed Sep. 25, 2008, which is the National Stage of International Application No. PCT/GB2006/002024, filed Jun. 5, 2006, which claims priority to and benefit of U.S. Provisional Patent Application Ser. No. 60/688,003, filed Jun. 7, 2005, and priority to and benefit of United Kingdom Patent Application No. 0511333.7, filed Jun. 3, 2005. The entire contents of these applications are incorporated herein by reference.

BACKGROUND OF THE INVENTION

The present invention relates to a mass spectrometer and a method of mass spectrometry.

It is known to transfer or guide ions through a region of a mass spectrometer which is maintained at a relatively high pressure. For example, ions may be transported from an atmospheric pressure ion source to a mass analyser which is maintained at a low pressure. It is known to use radio frequency (RF) ion guides comprising a plurality of rods or a plurality of electrodes having apertures through which ions are transmitted in order to transfer or guide the ions. The RF ion guide may be maintained at an intermediate pressure of, for example, $10^{-3}$-$10^{1}$ mbar.

An ion trap comprising a plurality of rod electrodes and additional electrodes to confine ions axially within the ion trap is also known. An ion trap comprising a plurality of electrodes having apertures through which ions are transmitted in use is also known.

SUMMARY OF THE INVENTION

According to the present invention there is provided a mass spectrometer and a method of mass spectrometry.

According to an aspect of the present invention there is provided a method of mass spectrometry comprising:

providing an ion guide or ion trap comprising one or more first electrodes and providing one or more exit electrodes downstream of the first electrodes;

trapping ions in a mode of operation within the ion guide or ion trap;

performing a plurality of cycles of operation, wherein each cycle of operation comprises the steps of: (i) enabling at least some ions to exit the ion guide or ion trap during a first time period $T_e$; and (ii) thereafter substantially preventing ions from exiting the ion guide or ion trap for a second time period $T_c$;

the method further comprising the step of:

varying the length or width of the first time period $T_e$ in subsequent cycles of operation.

The first electrodes preferably comprise a plurality of electrodes having an aperture through which ions are transmitted in use. At least 10%, 20%, 30%, 40%, 50%, 60%, 70%, 80%, 90%, 95% or 100% of the first electrodes have apertures which are preferably substantially the same size or which have substantially the same area. At least 10%, 20%, 30%, 40%, 50%, 60%, 70%, 80%, 90%, 95% or 100% of the electrodes preferably have apertures which become progressively larger and/or smaller in size or in area in a direction along the axis of the ion guide or ion trap. According to an embodiment at least 10%, 20%, 30%, 40%, 50%, 60%, 70%, 80%, 90%, 95% or 100% of the first electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) >6.0 mm; (vii) ≦7.0 mm; (viii) ≦8.0 mm; (ix) ≦9.0 mm; (x) ≦10.0 mm; and (xi) >10.0 mm.

According to a less preferred embodiment the ion guide or ion trap may comprise a multipole rod set ion guide or ion trap. The ion guide or ion trap may comprise a quadrupole, hexapole, octapole or higher order multipole rod set. The ion guide or ion trap may comprise a plurality of electrodes having an approximately or substantially circular cross-section, an approximately or substantially hyperbolic surface or an arcuate or part-circular cross-section.

The ion guide or ion trap preferably comprises x axial segments, wherein x is selected from the group consisting of: (i) 1-10; (ii) 11-20; (iii) 21-30; (iv) 31-40; (v) 41-50; (vi) 51-60; (vii) 61-70; (viii) 71-80; (ix) 81-90; (x) 91-100; and (xi) >100. Each axial segment preferably comprises 1, 2, 3, 4, 5, 6, 7, 8, 9, 10, 11, 12, 13, 14, 15, 16, 17, 18, 19, 20 or >20 electrodes. The axial length of at least 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The spacing between at least 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to an embodiment the ion guide or ion trap may comprise 1, 2, 3, 4, 5, 6, 7, 8 or 9 electrodes. According to another embodiment the ion guide or ion trap may comprise at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guide or ion trap preferably has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

A first AC or RF voltage is preferably applied to at least 10%, 20%, 30%, 40%, 50%, 60%, 70%, 80%, 90%, 95% or 100% of the first electrodes. The first AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The first AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The step of performing a plurality of cycles of operation preferably comprises performing at least 2, 5, 10, 20, 30, 40, 50, 60, 70, 80, 90, 100, 110, 120, 130, 140, 150, 160, 170, 180, 190, 200, 250, 300, 350, 400, 450, 500, 600, 700, 800, 900, 1000, 1000-1500, 1500-2000, 2000-2500, 2500-3000, 3000-3500, 3500-4000, 4000-4500, 4500-5000, 5000-5500, 5500-6000, 6000-6500, 6500-7000, 7000-7500, 7500-8000, 8000-8500, 8500-9000, 9000-9500, 9500-10000, 10000-15000, 15000-20000, 20000-25000, 25000-30000, 30000-35000, 35000-40000, 40000-45000, 45000-50000, 50000-55000, 55000-60000, 60000-65000, 65000-70000, 70000-75000, 75000-80000, 80000-85000, 85000-90000, 90000-95000, 95000-100000 or >100000 cycles of operation.

The step of performing the plurality of cycles of operation preferably comprises setting at least 2, 5, 10, 20, 30, 40, 50, 60, 70, 80, 90, 100, 110, 120, 130, 140, 150, 160, 170, 180, 190, 200, 250, 300, 350, 400, 450, 500, 600, 700, 800, 900, 1000, 1000-1500, 1500-2000, 2000-2500, 2500-3000, 3000-3500, 3500-4000, 4000-4500, 4500-5000, 5000-5500, 5500-6000, 6000-6500, 6500-7000, 7000-7500, 7500-8000, 8000-8500, 8500-9000, 9000-9500, 9500-10000, 10000-15000, 15000-20000, 20000-25000, 25000-30000, 30000-35000, 35000-40000, 40000-45000, 45000-50000, 50000-55000, 55000-60000, 60000-65000, 65000-70000, 70000-75000, 75000-80000, 80000-85000, 85000-90000, 90000-95000, 95000-100000 or >100000 different first time periods $T_e$ during the plurality of cycles of operation.

The first time period $T_e$ is preferably arranged to be different in or to have a unique value in at least 5%, 10%, 15%, 20%, 25%, 30%, 35%, 40%, 45%, 50%, 55%, 60%, 65%, 70%, 75%, 80%, 85%, 90%, 95% or 100% of the plurality of cycles of operation.

The first time period $T_e$ is preferably varied at least every $n^{th}$ consecutive cycle of operation for at least 5%, 10%, 15%, 20%, 25%, 30%, 35%, 40%, 45%, 50%, 55%, 60%, 65%, 70%, 75%, 80%, 85%, 90%, 95% or 100% of the plurality of cycles of operation, wherein n is selected from the group consisting of: (i) 1; (ii) 2; (iii) 3; (iv) 4; (v) 5; (vi) 6; (vii) 7; (viii) 8; (ix) 9; (x) 10; (xi) 11; (xii) 12; (xiii) 13; (xiv) 14; (xv) 15; (xvi) 16; (xvii) 17; (xviii) 18; (xix) 19; (xx) 20; and (xxi) >20.

Ions are preferably substantially prevented from entering the ion guide or ion trap whilst the plurality of cycles of operation are being performed.

According to the preferred embodiment further ions are preferably admitted into the ion guide or ion trap after having performed the plurality of cycles of operation.

According to the preferred embodiment the potential of the one or more exit electrodes is preferably lowered relative to at least some of the one or more first electrodes during at least some of the first time periods $T_e$.

The potential of the one or more first electrodes is preferably raised relative to the one or more exit electrodes during at least some of the first time periods $T_e$.

A second AC or RF voltage is preferably applied to the one or more exit electrodes such that the potential of the one or more exit electrodes periodically drops below the average DC potential of the first electrodes. The second AC or RF voltage preferably has a frequency selected from the group consisting of: (i) 0-10 kHz; (ii) 10-20 kHz; (iii) 20-30 kHz; (iv) 30-40 kHz; (v) 40-50 kHz; (vi) 50-60 kHz; (vii) 60-70 kHz; (viii) 70-80 kHz; (ix) 80-90 kHz; (x) 90-100 kHz; (xi) 100-110 kHz; (xii) 110-120 kHz; (xiii) 120-130 kHz; (xiv) 130-140 kHz; (xv) 140-150 kHz; (xvi) 150-160 kHz; (xvii) 160-170 kHz; (xviii) 170-180 kHz; (xix) 180-190 kHz; (xx) 190-200 kHz; (xxi) 200-250 kHz; (xxii) 250-300 kHz; (xxiii) 300-350 kHz; (xxiv) 350-400 kHz; (xxv) 400-450 kHz; (xxvi) 450-500 kHz; and (xxvii) >500 kHz. The amplitude of the second AC or RF voltage is preferably selected from the group consisting of: (i) <1 V; (ii) 1-2 V; (iii) 2-3 V; (iv) 3-4 V; (v) 4-5 V; (vi) 5-6 V; (vii) 6-7 V; (viii) 7-8 V; (ix) 8-9 V; (x) 9-10 V; (xi) 10-15 V; (xii) 15-20 V; (xiii) 20-25 V; (xiv) 25-30 V; (xv) 30-35 V; (xvi) 35-40 V; (xvii) 40-45 V; (xviii) 45-50 V; and (xix) >50 V.

The step of varying the length or width of the first time period $T_e$ in subsequent cycles of operation preferably comprises progressively decreasing, increasing, varying or scanning the frequency of the second AC or RF voltage.

The step of varying the length or width of the first time period $T_e$ in subsequent cycles of operation preferably comprises progressively decreasing, increasing, varying or scanning the amplitude of the second AC or RF voltage.

According to the preferred embodiment during at least 5%, 10%, 15%, 20%, 25%, 30%, 35%, 40%, 45%, 50%, 55%, 60%, 65%, 70%, 75%, 80%, 85%, 90%, 95% or 100% of the plurality of cycles of operation the first time period $T_e$ is selected from the group consisting of: (i) <0.1 μs; (ii) 0.1-0.5 μs; (iii) 0.5-1.0 μs; (iv) 1.0-1.5 μs; (v) 1.5-2.0 μs; (vi) 2.0-2.5 μs; (vii) 2.5-3.0 μs; (viii) 3.0-3.5 μs; (ix) 3.5-4.0 μs; (x) 4.0-4.5 μs; (xi) 4.5-5.0 μs; (x) 5.0-5.5 μs; (xi) 5.5-6.0 μs; (xii) 6.0-6.5 μs; (xiii) 6.5-7.0 μs; (xiv) 7.0-7.5 μs; (xv) 7.5-8.0 μs; (xvi) 8.0-8.5 μs; (xvii) 8.5-9.0 μs; (xviii) 9.0-9.5 μs; (xix) 9.5-10.0 μs; (xx) 10-20 μs; (xxi) 20-30 μs; (xxii) 30-40 μs; (xxiii) 40-50 μs; (xxiv) 50-60 μs; (xxv) 60-70 μs; (xxvi) 70-80 μs; (xxvii) 80-90 μs; (xxviii) 90-100 μs; and (xxix) >100 μs.

According to the preferred embodiment during at least 5%, 10%, 15%, 20%, 25%, 30%, 35%, 40%, 45%, 50%, 55%, 60%, 65%, 70%, 75%, 80%, 85%, 90%, 95% or 100% of the plurality of cycles of operation the second time period $T_c$ is selected from the group consisting of: (i) <0.1 μs; (ii) 0.1-0.5 μs; (iii) 0.5-1.0 μs; (iv) 1.0-1.5 μs; (v) 1.5-2.0 μs; (vi) 2.0-2.5 μs; (vii) 2.5-3.0 μs; (viii) 3.0-3.5 μs; (ix) 3.5-4.0 μs; (x) 4.0-4.5 μs; (xi) 4.5-5.0 μs; (x) 5.0-5.5 μs; (xi) 5.5-6.0 μs; (xii) 6.0-6.5 μs; (xiii) 6.5-7.0 μs; (xiv) 7.0-7.5 μs; (xv) 7.5-8.0 μs; (xvi) 8.0-8.5 μs; (xvii) 8.5-9.0 μs; (xviii) 9.0-9.5 μs; (xix) 9.5-10.0 μs; (xx) 10-20 μs; (xxi) 20-30 μs; (xxii) 30-40 μs; (xxiii) 40-50 μs; (xxiv) 50-60 μs; (xxv) 60-70 μs; (xxvi) 70-80 μs; (xxvii) 80-90 μs; (xxviii) 90-100 μs; and (xxix) >100 μs.

The step of varying the length or width of the first time period $T_e$ in subsequent cycles of operation preferably comprises progressively increasing, progressively decreasing, progressively varying, scanning, linearly increasing, linearly decreasing, increasing in a stepped, progressive or other manner or decreasing in a stepped, progressive or other manner the first time period $T_e$.

The first time period $T_e$ is preferably increased, varied or decreased by at least y % over 2, 5, 10, 20, 30, 40, 50, 60, 70, 80, 90, 100, 110, 120, 130, 140, 150, 160, 170, 180, 190, 200, 250, 300, 350, 400, 450, 500, 600, 700, 800, 900, 1000, 1000-1500, 1500-2000, 2000-2500, 2500-3000, 3000-3500, 3500-4000, 4000-4500, 4500-5000, 5000-5500, 5500-6000, 6000-6500, 6500-7000, 7000-7500, 7500-8000, 8000-8500, 8500-9000, 9000-9500, 9500-10000, 10000-15000, 15000-20000, 20000-25000, 25000-30000, 30000-35000, 35000-40000, 40000-45000, 45000-50000, 50000-55000, 55000-60000, 60000-65000, 65000-70000, 70000-75000, 75000-80000, 80000-85000, 85000-90000, 90000-95000, 95000-100000 or >100000 consecutive cycles of operation, wherein y is selected from the group consisting of: (i) <0.001; (ii) <0.01; (iii) <0.1; (iv) <1; (v) 1-2; (vi) 2-3; (vii) 3-4; (viii) 4-5; (ix) 5-10; (x) 10-15; (xi) 15-20; (xii) 20-25; (xiii) 25-30; (xiv) 30-35; (xv) 35-40; (xvi) 40-45; (xvii) 45-50; (xviii) 50-55; (xix) 55-60; (xx) 60-65; (xxi) 65-70; (xxii) 70-75; (xxiii) 75-80; (xxiv) 80-85; (xxv) 85-90; (xxvi) 90-95; and (xxvii) 95-100.

The one or more exit electrodes preferably comprise one or more apertures through which ions are transmitted in use.

During the first time period $T_e$ at least some ions within the ion guide or ion trap are preferably free to exit the ion guide or ion trap and pass through the one or more apertures in the one or more exit electrodes.

During the first time period $T_e$ ions are preferably not resonantly ejected from the ion guide or ion trap. During the first time period $T_e$ at least some ions preferably exit the ion guide or ion trap by virtue of their motion.

According to a preferred embodiment an extraction electric field is preferably applied along at least a portion of the length of the ion guide or ion trap during the first time period $T_e$ in order to accelerate at least some ions out of the ion guide or ion trap.

some ions within the ion guide or ion trap are preferably free to exit the ion guide or ion trap and pass through the one or more apertures in the one or more exit electrodes.

During the first time period $T_e$ ions are preferably not resonantly ejected from the ion guide or ion trap. During the first time period $T_e$ at least some ions preferably exit the ion guide or ion trap by virtue of their motion.

According to a preferred embodiment an extraction electric field is preferably applied along at least a portion of the length of the ion guide or ion trap during the first time period $T_e$ in order to accelerate at least some ions out of the ion guide or ion trap.

One or more entrance electrodes are preferably provided upstream of the first electrodes.

In a mode of operation the one or more entrance electrodes are preferably maintained at a potential such that ions trapped within the ion guide or ion trap are unable to exit the ion guide or ion trap via the one or more entrance electrodes. One or more gate electrodes are preferably provided upstream of the first electrodes. In a mode of operation the potential of the one or more gate electrodes is preferably controlled so that ions are admitted or pulsed into the ion guide or ion trap.

A further ion trap may according to one embodiment be provided upstream of the ion guide or ion trap.

According to an embodiment a mass filter/analyser may be provided downstream of the ion guide or ion trap. The mass filter/analyser may comprise a scanning quadrupole rod set mass filter/analyser.

According to an embodiment a second ion guide or ion trap may be provided downstream of the ion guide or ion trap, the second ion guide or ion trap comprising a plurality of electrodes. One or more transient DC voltages or potentials or one or more transient DC voltage or potential waveforms may be applied to the plurality of electrodes comprising the second ion guide or ion trap. The one or more transient DC voltages may create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells. The one or more transient DC voltage or potential waveforms may comprise a repeating waveform or square wave. Preferably, a plurality of axial potential wells are translated along the length of the second ion guide or ion trap.

According to an embodiment ions are preferably collisionally cooled or substantially thermalised within the ion guide or ion trap.

According to an embodiment ions may be fragmented within the ion guide or ion trap in a further mode of operation.

According to an embodiment ions may be resonantly and/or mass selectively ejected from the ion guide or ion trap in a further mode of operation.

The ion guide or ion trap is preferably arranged to act as a mass filter or mass analyser.

One or more transient DC voltages or potentials or one or more transient DC voltage or potential waveforms may be applied to the first electrodes in a mode of operation. The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells. The one or more transient DC voltage or potential waveforms preferably comprise a repeating waveform or square wave.

Ions are preferably ionised using an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; and (xvi) a Nickel-63 radioactive ion source.

The ion source may comprise a continuous or pulsed ion source.

The preferred embodiment preferably further comprises introducing, axially injecting or ejecting, radially injecting or ejecting, transmitting or pulsing ions into the ion guide or ion trap in a mode of operation.

Ions are preferably mass analysed by a mass analyser. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Ion Cyclotron Resonance mass spectrometer; and (xiii) an electrostatic Fourier Transform mass spectrometer.

According to an aspect of the present invention there is provided apparatus comprising:

an ion guide or ion trap comprising one or more first electrodes;

one or more exit electrodes arranged downstream of the first electrodes; and control means arranged to trap ions in a mode of operation within the ion guide or ion trap and to perform a plurality of cycles of operation, wherein in each cycle of operation at least some ions are enabled to exit the ion guide or ion trap during a first time period $T_e$ and thereafter ions are substantially prevented from exiting the ion guide or ion trap for a second time period $T_c$;

wherein the control means is further arranged to vary the length or width of the first time period $T_e$ in subsequent cycles of operation.

According to another aspect of the present invention there is provided an ion trap wherein, in use, ions are repeatedly pulsed out of or allowed to exit from the ion trap and wherein the width of a time window during which ions can exit the ion trap is progressively increased.

According to another aspect of the present invention there is provided a method comprising:

repeatedly pulsing ions out of or allowing ions to exit from an ion trap; and progressively increasing the width of a time window during which ions can exit the ion trap.

The preferred embodiment relates to an ion guide or ion trap which traps ions and which then subsequently releases ions from the ion guide or ion trap. Advantageously, ions are preferably released from the preferred ion guide or ion trap in order of the mass to charge ratio of the ions. The preferred ion guide or ion trap is therefore preferably able to operate as a mass separator or low resolution mass analyser.

The preferred ion guide or ion trap preferably comprises an ion storage device. An inhomogeneous RF electric field is preferably used to confine ions radially within the preferred ion guide or ion trap. Ions are preferably also confined axially within the preferred ion guide or ion trap in a mode of operation by applying a DC voltage to an electrode located at the entrance and/or exit of the preferred ion guide or ion trap. The entrance and/or exit electrode preferably comprises an electrode having an aperture through which ions are preferably transmitted in use.

Once ions have been trapped within the preferred ion guide or ion trap an AC voltage is preferably applied to the exit electrode. The frequency of the AC voltage which is preferably applied to the exit electrode is preferably progressively reduced and/or the amplitude of the AC voltage is preferably progressively increased. As a result ions of increasing mass to charge ratio are preferably able to emerge from the preferred ion guide or ion trap. Ions which are released from the preferred ion guide or ion trap preferably pass through an aperture in the exit electrode. The ions may then pass through other ion-optical components prior to being mass analysed by a high resolution mass analyser.

According to an embodiment the preferred ion guide or ion trap is preferably provided upstream of a mass analyser such as a Time of Flight mass analyser. The preferred ion guide or ion trap is preferably operated in a manner such that the sampling duty cycle of the mass analyser is preferably improved.

According to an embodiment the preferred ion guide or ion trap may be maintained at a relatively high pressure. For example, the preferred ion guide or ion trap may be maintained, in a mode of operation, at a pressure of $10^{-3}$-$10^{1}$ mbar such that ion-molecule collisions are preferably relatively frequent within the preferred ion guide or ion trap. As a result ions are preferably arranged to be substantially thermalised within the preferred ion guide or ion trap without being fragmented.

After a short period of time ions which are trapped within the preferred ion guide or ion trap will preferably have undergone sufficient collisions with background gas molecules such that the ions will then possess thermal energy. Under these conditions the ions will posses a velocity which can be described by the Maxwell-Boltzmann distribution. Ions of mass m can be assumed as having a Gaussian velocity distribution with a mean velocity of zero and a standard deviation of $(kT/m)^{1/2}$ wherein k is the Boltzmann constant and T is the absolute temperature.

According to the preferred embodiment once ions have been trapped within the preferred ion guide or ion trap the potential of the exit electrode of the preferred ion guide or ion trap is preferably reduced for a relatively short period of time $T_e$. Some ions are then preferably able to exit the preferred ion guide or ion trap via the aperture in the exit electrode before the potential of the exit electrode is raised to a level such that all ions are preferably axially confined within the preferred ion guide or ion trap.

The ability of an ion to escape, exit or emerge from the preferred ion guide or ion trap during the time period $T_e$ will depend upon the initial axial position of the ion, the initial axial velocity of the ion and the axial acceleration which the ion may experience due to an extraction electric field being present or applied along at least a portion of the length of the preferred ion guide or ion trap during the time period $T_e$.

When ions are stored within the preferred ion guide or ion trap then after a short period of time it may be expected that any particular ion will have a random axial position along the axis or length of the preferred ion guide or ion trap. The axial position of the ion should be substantially independent of the mass or charge of the ion. It can also be assumed that the velocity of an ion under such circumstances can be described by the Maxwell-Boltzmann distribution. If an extraction electric field is then applied at one end of the preferred ion guide or ion trap during a time period $T_e$ when the potential of the exit electrode is lowered allowing some ions to escape, then the resulting acceleration of an ion due to the applied extraction electric field will be a function of the mass to charge ratio of the ion. Accordingly, the probability of an ion escaping from, exiting or emerging from the preferred ion guide or ion trap during the time period $T_e$ will be a function of the mass to charge ratio of the ion. The preferred ion guide or ion trap therefore preferably acts as a mass separator or mass analyser in that ions emerge from the preferred ion guide or ion trap depending upon the mass to charge ratio of the ion. However, it will also be apparent that ions are not resonantly ejected from the preferred ion guide as is the case with conventional ion traps.

Once some ions have exited the preferred ion guide or kin trap during the time period $T_e$ the voltage or potential of the exit electrode is preferably raised in order to confine ions axially within the preferred ion guide or ion trap. The voltage or potential of the exit electrode is preferably kept high for a period of time $T_c$ which is preferably sufficient to allow the spatial and energy distributions of the ions to re-normalise. Once the spatial and energy distributions of the ions has been normalised the voltage or potential of the exit electrode may again be lowered for a period of time enabling ions to escape, exit or emerge from the preferred ion guide or ion trap.

According to the preferred embodiment the time period $T_e$ may be slightly increased in subsequent cycles of operation. As a result ions having a slightly different range of mass to charge ratios can be arranged to emerge from the preferred ion guide or ion trap at the end of each cycle of operation. After multiple cycles of operation preferably all ions emerge or are emitted from the preferred ion guide or ion trap.

According to the preferred embodiment the time period $T_e$ is preferably initially set to be relatively quite short. As a result only ions having a relatively low mass to charge ratio escape from the preferred ion guide or ion trap during the initial time period $T_e$ or cycle of operation. The time period $T_e$ during which time the potential of the exit electrode is lowered is preferably progressively increased at subsequent cycles such that ions having progressively higher mass to charge ratios preferably emerge from the preferred ion guide or ion trap. Ions are therefore selectively released from the preferred ion guide or ion trap in a mass to charge ratio dependent manner but without being resonantly excited.

A particularly advantageous aspect of the preferred embodiment is that the mass separation and selective mass release of ions from the preferred ion guide or ion trap can preferably be performed at a relatively high pressure. Also according to the preferred embodiment an ion guide or ion trap of a mass spectrometer can be modified according to the preferred embodiment so that the ion guide or ion trap can operate in an additional mode of operation wherein ions are separated according to their mass to charge ratio. An existing mass spectrometer can therefore be modified to provide additional functionality without increasing the overall size or cost of the mass spectrometer.

The preferred ion guide or ion trap may according to an embodiment be used in conjunction with a scanning or stepped quadrupole mass filter and associated ion detector. According to another embodiment the preferred ion guide or ion trap may be used in conjunction with an orthogonal acceleration Time of Flight mass analyser. The preferred ion guide or ion trap preferably enables the overall duty cycle of a mass analyser or mass spectrometer to be improved thereby improving the overall instrument sensitivity.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
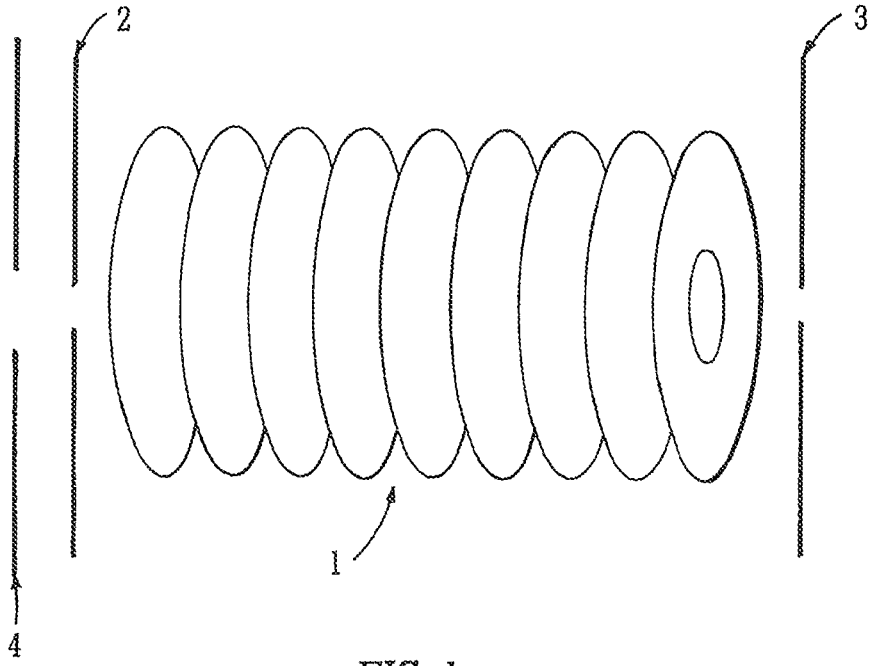
FIG. 1 shows a preferred ion guide or ion trap comprising a plurality of electrodes having apertures through which ions are transmitted in use and an exit and entrance electrode for confining ions within the preferred ion guide or ion trap.

A preferred ion guide or ion trap will now be described with reference to FIG. 1. The ion guide or ion trap 1 preferably comprises a plurality of electrodes having apertures. An entrance electrode 2 is preferably provided upstream of the preferred ion guide or ion trap 1 and an exit electrode 3 is preferably provided downstream of the preferred ion guide or ion trap 1. The entrance electrode 2 and the exit electrode 3 preferably comprise an electrode having an aperture through which ions are transmitted in use. A gate electrode 4 is preferably provided upstream of the entrance electrode 2. The gate electrode 4 preferably controls the transmission of ions to the preferred ion guide or ion trap 1. The gate electrode 4 preferably comprises an electrode having an aperture through which ions are transmitted in use.

Ions are preferably radially confined within the preferred ion guide or ion trap 1 by the application of a AC or RF voltage to the electrodes forming the preferred ion guide or ion trap 1. The applied AC or RF voltage results in a pseudo-potential well being formed within the preferred ion guide or ion trap 1 which preferably confines ions radially within the ion guide or ion trap. In order to confine ions axially within the preferred ion guide or ion trap 1 the entrance electrode 2 and/or the exit electrode 3 are preferably maintained at a raised DC potential relative to the other electrodes forming the ion guide or ion trap 1 in an ion trapping mode of operation.

According to a less preferred embodiment the ion guide or ion trap 1 may comprise a quadrupole, hexapole, octapole or higher order rod set ion guide or ion trap. Also, according to other less preferred embodiments the gate electrode 4 and/or entrance electrode 2 and/or exit electrode 3 may comprise an electrode other than an electrode having an aperture through which ions are transmitted.

Figure 2:
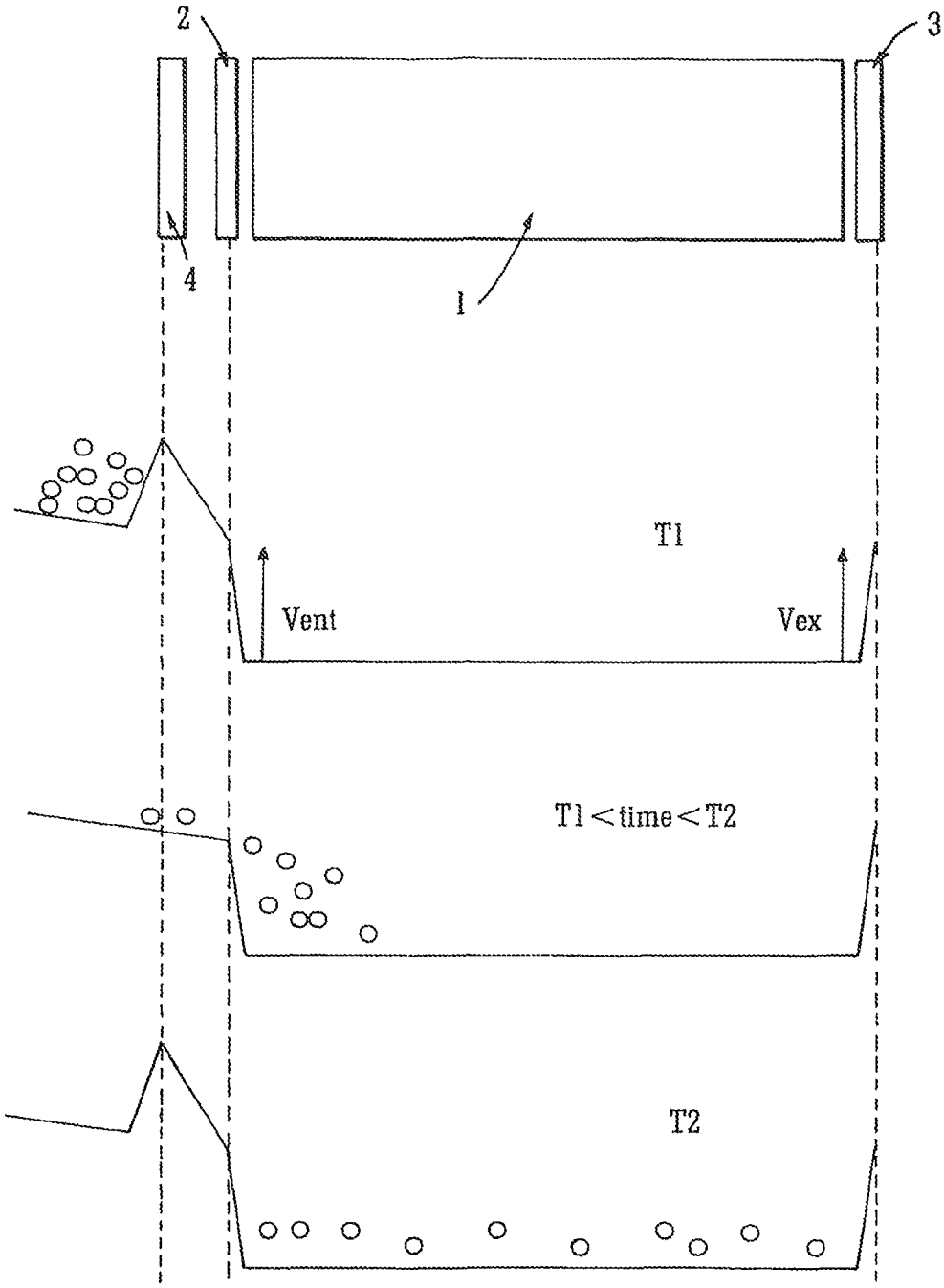
FIG. 2 shows potential energy diagrams of a preferred ion guide or ion trap when ions are initially admitted into the preferred ion guide or ion trap and when the ions are subsequently trapped within the preferred ion guide or ion trap.

FIG. 2 shows potential energy diagrams relating to the steps of initially admitting ions in to the preferred ion guide or ion trap and then axially trapping the ions within the preferred ion guide or ion trap 1. As a first step a controlled population of ions is preferably allowed to enter the ion guide or ion trap 1 by modulating the potential of the gate electrode 4 which is preferably arranged upstream of the entrance electrode 2. At a time T1 before ions are admitted to the preferred ion guide or ion trap the potential of the gate electrode 4 preferably prevents ions from passing beyond the gate electrode 4 and entering the ion guide or ion trap 1. Then, at a later time the potential of the gate electrode 4 is preferably lowered allowing ions to pass through or beyond the gate electrode 4 and to pass through or beyond the entrance electrode 2 and to enter the preferred ion guide or ion trap 1. An ion population is then preferably trapped axially within the ion guide or ion trap 1 by maintaining the potential of the entrance electrode 2 and the exit electrode 3 at a relatively high potential relative to the potential of the other electrodes forming the preferred ion guide or ion trap 1. Ions are confined axially within the preferred ion guide or ion trap 1 since ions within the preferred ion guide or ion trap 1 are arranged to posses energies such that they are incapable of breaching the potential barriers Vent and Vex present at the entrance and exit of the preferred ion guide or ion trap 1.

At a subsequent time T2 the potential of the gate electrode 4 is then preferably raised to a relatively high potential thereby preventing further ions from entering the preferred ion guide or ion trap 1. After a short period of time the ions which are trapped within the preferred ion guide or ion trap 1 become substantially evenly distributed along the length of the preferred ion guide or ion trap 1 since the ions possess substantially thermal energies following multiple collisions with background gas molecules present within the preferred ion guide or ion trap 1.

Figure 3A:
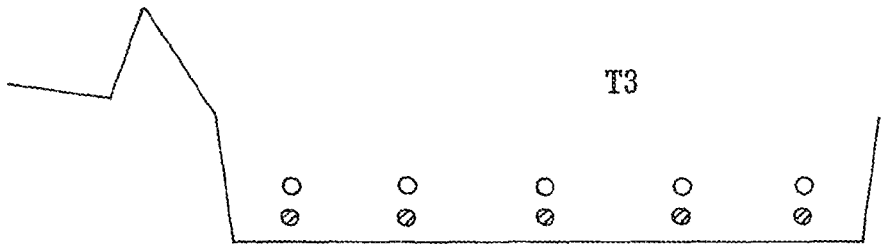
FIG. 3A shows a potential energy diagram of a mixture of relatively high and low mass to charge ratio ions which have been thermalised and allowed to assume an even distribution along the length of a preferred ion guide or ion trap.
Figure 3B:
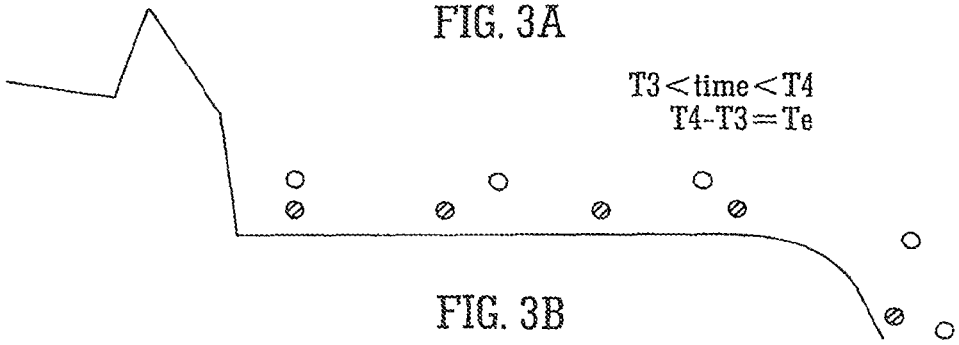
FIG. 3B shows a potential energy diagram of an extraction field applied to or present at the exit region of the preferred ion guide or ion trap and FIG. 3C shows a potential energy diagram at a subsequent time when a trapping potential is reapplied to the exit electrode of the preferred ion guide or ion trap.
Figure 3C:
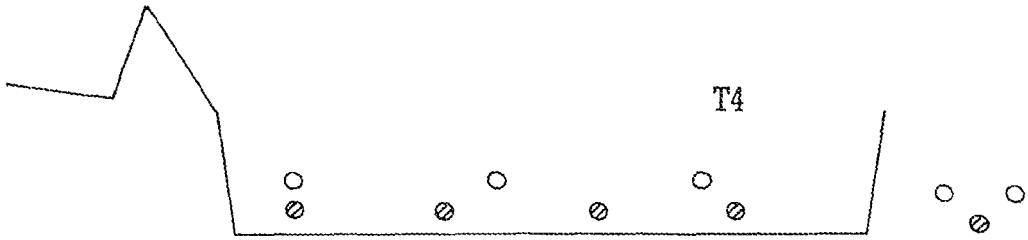

FIG. 3A shows a mixture of ions having relatively low and relatively high mass to charge ratios. In FIGS. 3A-3C the white circles represent ions having relatively low mass to charge ratios and the black circles represent ions having relatively high mass to charge ratios. At a time T3 ions having different mass to charge ratios can be considered as being essentially evenly distributed within and along the RF ion guide or ion trap 1 as shown in FIG. 3A.

At a time subsequent to T3 the voltage or potential of the exit electrode 3 is preferably reduced for a relatively short period of time $T_e$. FIG. 3B shows the potential energy of the preferred ion guide or ion trap at the point in time when the voltage or potential of the exit electrode 3 is reduced. When the voltage or potential of the exit electrode 3 is reduced ions are free to escape from or exit the preferred ion guide or ion trap 1. The ions which exit or escape from the preferred ion guide or ion trap 1 preferably pass through the aperture in the exit electrode 3. Whether or not a particular ion escapes from or exits the preferred ion guide or ion trap 1 during the time period $T_e$ will depend upon the initial axial position of the ion, the axial acceleration of the ion due to an extraction electric field which is preferably present or applied across at least a portion of the exit region of the preferred ion guide or ion trap 1 during the time period $T_e$ by virtue of reducing the voltage or potential of the exit electrode 3, and the initial axial velocity of the ion. The axial acceleration of an ion will depend upon the mass to charge ratio of the ion.

For a certain relatively narrow time period $T_e$ ions having a relatively low mass to charge ratio will have a relatively higher probability of escaping from, exiting or emerging from the preferred ion guide or ion trap 1 than ions having a relatively higher mass to charge ratio when an extraction electric field is present or applied along at least a portion of the preferred ion guide or ion trap 1 preferably by virtue of the voltage or potential of the exit electrode being reduced.

FIGS. 3B and 3C illustrates two ions having relatively low mass to charge ratios escaping from or exiting the preferred ion guide or ion trap 1 during a time period $T_e$ whereas only one ion having a relatively high mass to charge ratio is able to escape from or exit the preferred ion guide or ion trap 1 during the same time period $T_e$.

According to a particularly preferred embodiment the time period $T_e$ may initially be set to be relatively short. In subsequent cycles of operation the time period $T_e$ may preferably be increased progressively. As a result ions preferably emerge or escape from the preferred ion guide or ion trap 1 in a mass to charge ratio dependent manner. If the time period $T_e$ is progressively increased in subsequent cycles then ions having relatively low mass to charge ratios preferably emerge, escape or otherwise exit the preferred ion guide or ion trap 1 prior to ions having relatively high mass to charge ratios. The ions are not resonantly ejected from the preferred ion guide or ion trap 1 as is the case with a conventional ion trap. Instead, ions escape, exit or emerge from the preferred ion guide or ion trap 1 by virtue of their motion and an extraction electric field which is preferably present towards the exit region of the preferred ion guide or ion trap 1.

Figure 4:
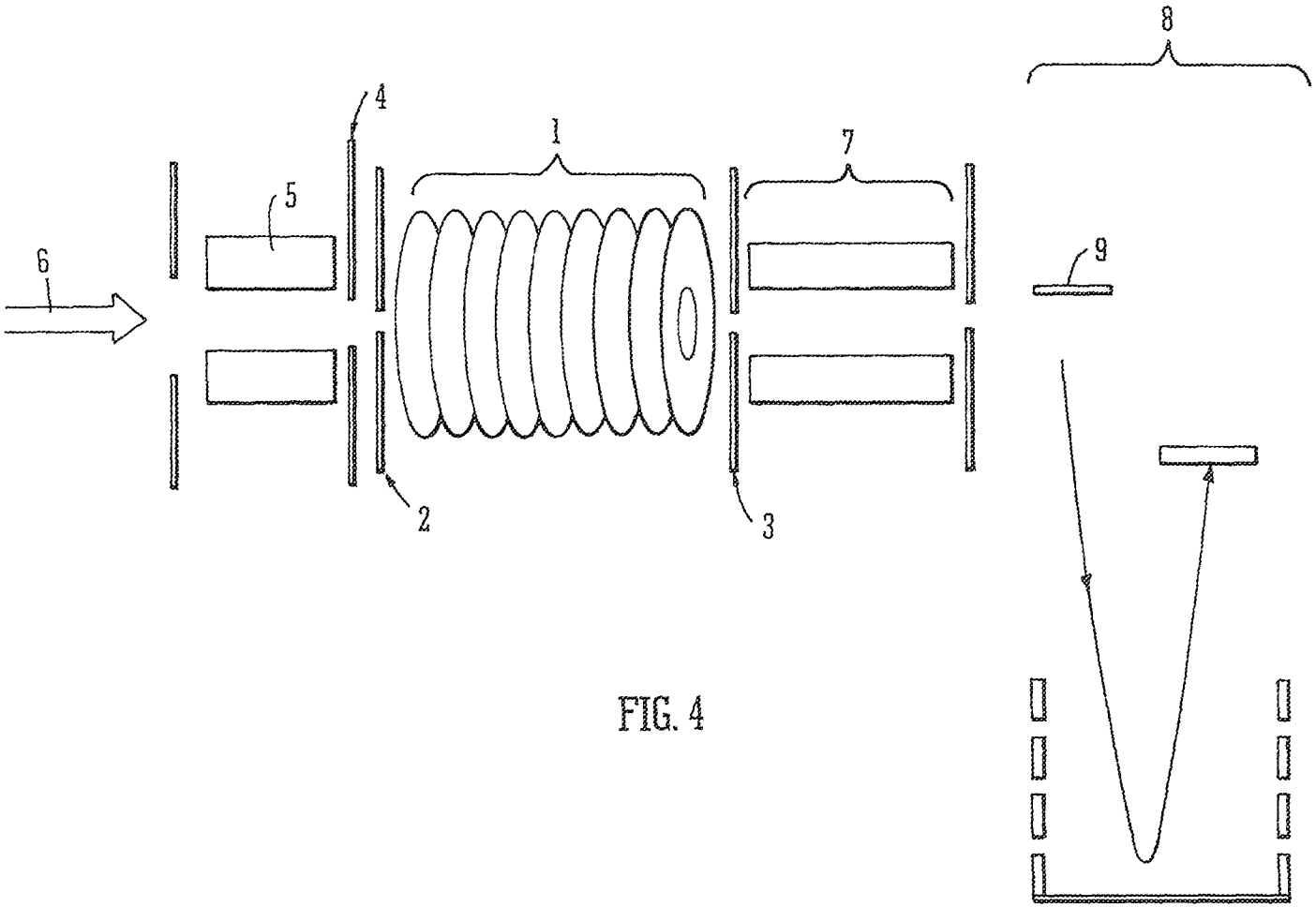
FIG. 4 shows an embodiment wherein a preferred ion guide or ion trap is provided upstream of an orthogonal acceleration Time of Flight mass analyser.
Figure 5A:
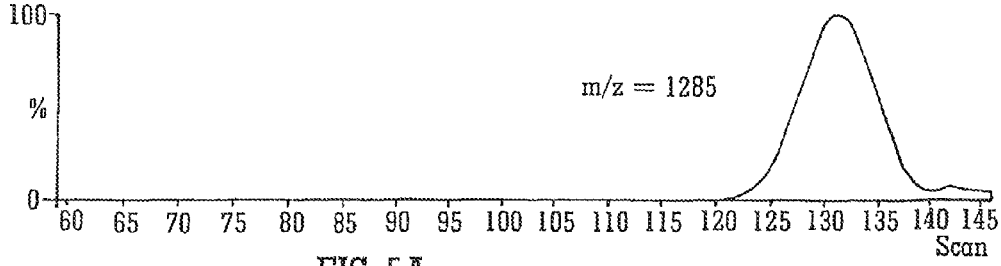
FIG. 5A shows a mass chromatogram obtained according to an embodiment of the present invention for ions having a mass to charge ratio of 1285.
Figure 5B:
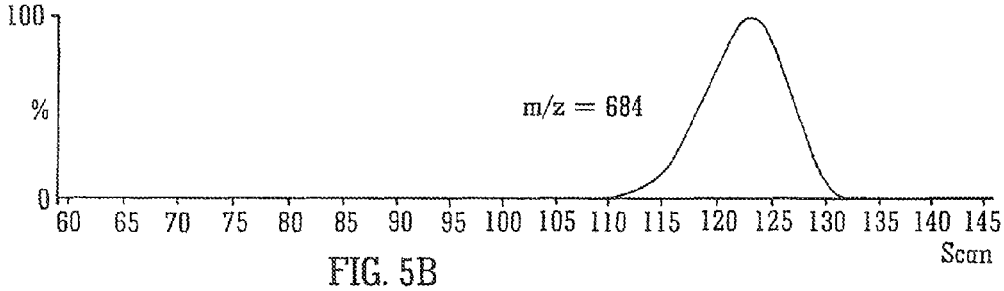
FIG. 5B shows a mass chromatogram obtaining according to an embodiment of the present invention for ions having a mass to charge ratio of 684.
Figure 5C:
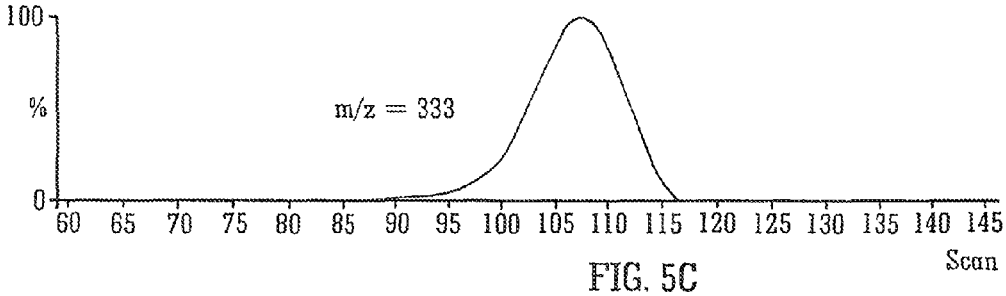
FIG. 5C shows a mass chromatogram obtaining according to an embodiment of the present invention for ions having a mass to charge ratio of 333 and FIG. 5D shows a mass chromatogram obtaining according to an embodiment of the present invention for ions having a mass to charge ratio of 175.
Figure 5D:
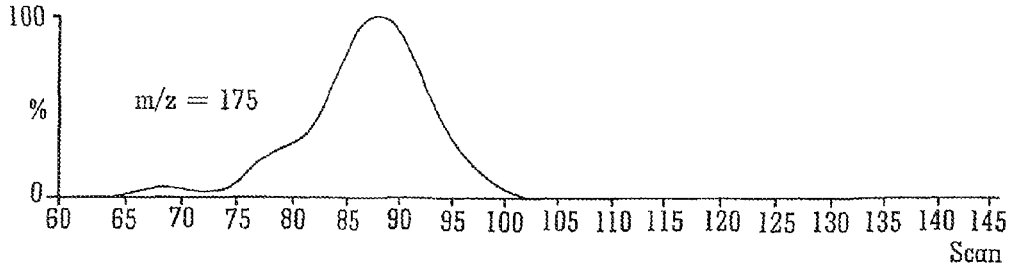

FIG. 4 shows an embodiment wherein an additional ion trap 5 is provided upstream of the preferred ion guide or ion trap 1. An entrance electrode 2 is preferably provided upstream of the preferred ion guide or ion trap 1 and an exit electrode 3 is preferably provided downstream of the preferred ion guide or ion trap 1.

The additional ion trap 5 preferably receives ions 6 from an ion source (not shown). The ions are preferably trapped in the additional ion trap 5 and a population of ions is preferably periodically released from the additional ion trap 5. Ions are preferably released from the additional ion trap 5 by lowering the potential of a gate electrode 4 which is preferably arranged downstream of the additional ion trap 5 and upstream of the entrance electrode 2. Ions are preferably admitted into the preferred ion guide or ion trap 1 by modulating the potential or voltage applied to the gate electrode 4.

The entrance and exit electrodes 2,3 are preferably maintained at a potential such that ions are trapped axially within the preferred ion guide or ion trap 1 in an ion trapping mode of operation. After a short period of time the ion population within the preferred ion guide or ion trap 1 preferably cools to thermal energies and the ions preferably become subsequently evenly distributed along or throughout the length of the preferred ion guide or ion trap 1. Once ions have become evenly distributed along the length of the preferred ion guide or ion trap 1 an AC or RF voltage or voltage waveform is preferably applied to the exit electrode 3.

The AC or RF voltage or voltage waveform which is preferably applied to the exit electrode 3 preferably causes the potential of the exit electrode 3 to drop below the DC potential of the electrodes forming the preferred ion guide or ion trap 1 for a relatively short period of time $T_e$. During this relatively short period of time $T_e$ some ions are preferably able to escape, exit or emerge from the preferred ion guide or ion trap 1 via the aperture in the exit electrode 3. The period of time $T_e$ during which time the potential of the exit electrode 3 enables ions to escape is related to the reciprocal of the frequency of the applied AC or RF voltage or voltage waveform.

Ions that escape, exit or emerge from the preferred ion guide or ion trap 1 are then preferably arranged to pass via transfer optics 7 to an orthogonal acceleration Time of Flight mass analyser 8. The Time of Flight mass analyser 8 preferably comprises an orthogonal acceleration electrode 9 for orthogonally accelerating ions into a drift or time of flight region of the mass analyser 8. The ions are then preferably mass analysed by the orthogonal acceleration Time of Flight mass analyser 8 and the mass to charge ratio of the ions is preferably determined.

FIGS. 5A-5D show some mass chromatograms which were constructed using a mass spectrometer arranged substantially as shown in FIG. 4 and operated in accordance with the preferred embodiment of the present invention. Fragment ions from the peptide Glu-Fibrinopeptide-B were ejected from an additional ion trap 5 arranged upstream of a preferred ion guide or ion trap 1. The ions were then admitted into the preferred ion guide or ion trap 1 for a 5 s period of time by modulating the potential of the gate electrode 4. The entrance and exit electrodes 2,3 were maintained at a potential which was +5 V with respect to the DC potential of the electrodes forming the preferred ion guide or ion trap 1.

Once ions were axially trapped or confined within the preferred ion guide or ion trap 1 and had an opportunity to acquire thermal energies upon multiple collisions with background gas molecules a sinusoidal AC voltage or voltage waveform was then applied to the exit electrode 3. The AC voltage or voltage waveform was offset at +5 V with respect to the DC potential of the electrodes forming the preferred ion guide or ion trap 1. The AC voltage waveform had a peak to peak amplitude of 20 V.

Initially, the frequency of the AC voltage waveform was set to 100 kHz. This corresponded to a time period $T_e$ of approximately 3.3 μs during which time ions were free to escape or exit from the preferred ion guide or ion trap 1. For scans 1-40 the frequency of the applied AC voltage waveform was maintained at 100 kHz. At scan 41 the frequency of the applied AC voltage waveform was reduced to 99 kHz. The frequency of the applied AC voltage waveform was then further reduced by 1 kHz at each subsequent scan until all the ions had effectively exited the preferred ion guide or ion trap 1.

The orthogonal acceleration Time of Flight mass analyser 8 was set to continually acquire ions and mass analyse the ions during this process. Reconstructed mass chromatograms for four different species of ions are shown in FIGS. 5A-5D. It is apparent from FIGS. 5A-5D that the frequency of the applied AC voltage waveform and therefore the time period $T_e$ controls which species of ion are able to escape from or exit from the preferred ion guide or ion trap 1.

Figure 6:
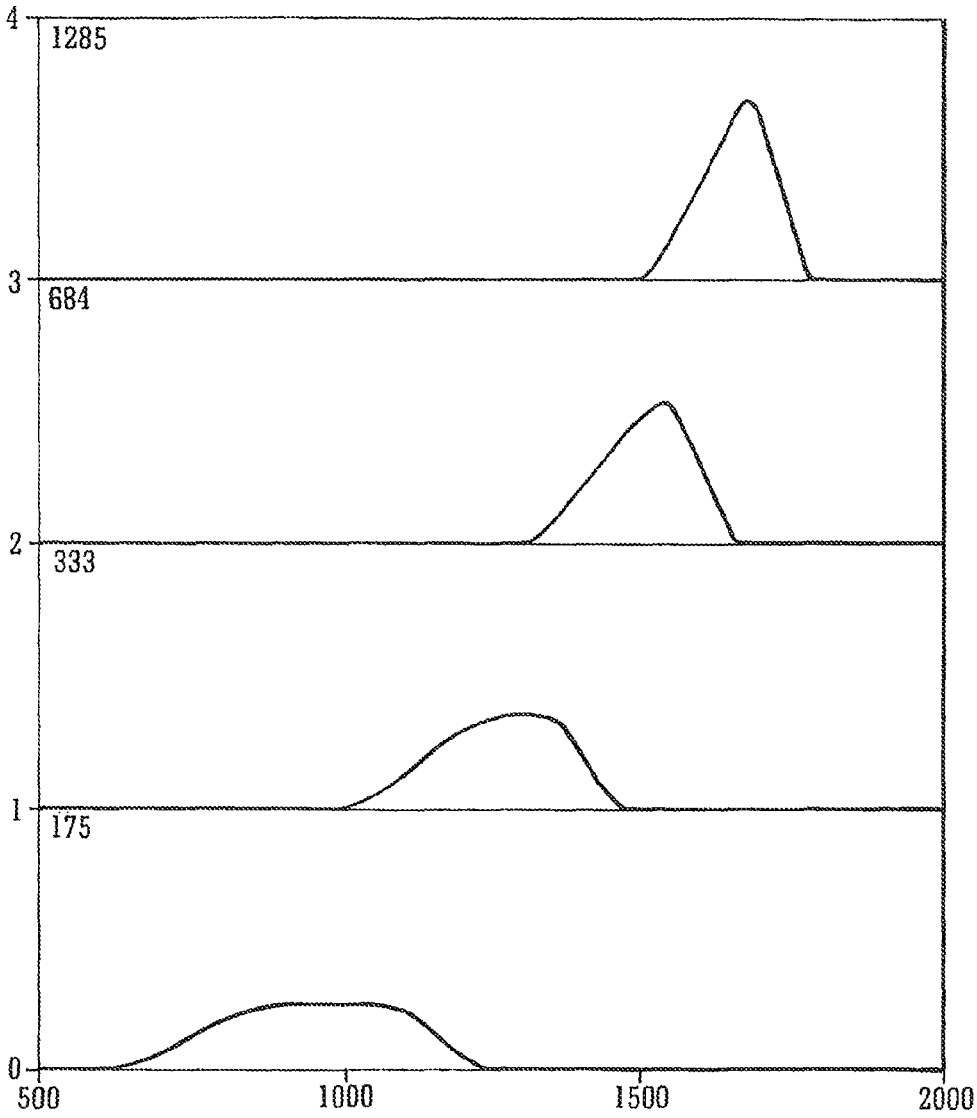
FIG. 6 shows theoretical mass chromatograms which were predicted for ions having mass to charge ratios of 1285, 684, 333 and 175 according to a computer model.

The process was then modelled in order to compare the experimental data with theoretical data. An initial random axial distribution of ions was assumed with thermal energies according to the Maxwell-Boltzmann distribution. The expected theoretical relationship between the mass to charge ratio of an ion emerging from the preferred ion guide or ion trap 1 and the frequency or scan number is shown in FIG. 6. As can be seen, there is a close correlation between the theoretical mass chromatograms shown in FIG. 6 and the experimentally observed mass chromatograms as shown in FIGS. 5A-5D.

A particularly advantageous aspect of the preferred ion guide or ion trap 1 is that the preferred RF ion guide or ion trap 1 is a low loss device since ions which do not escape in a particular pulse period or cycle are preferably maintained within the preferred ion guide or ion trap 1. The ions preferably escape or exit the preferred ion guide or ion trap 1 in a subsequent scan.

Figure 7A:
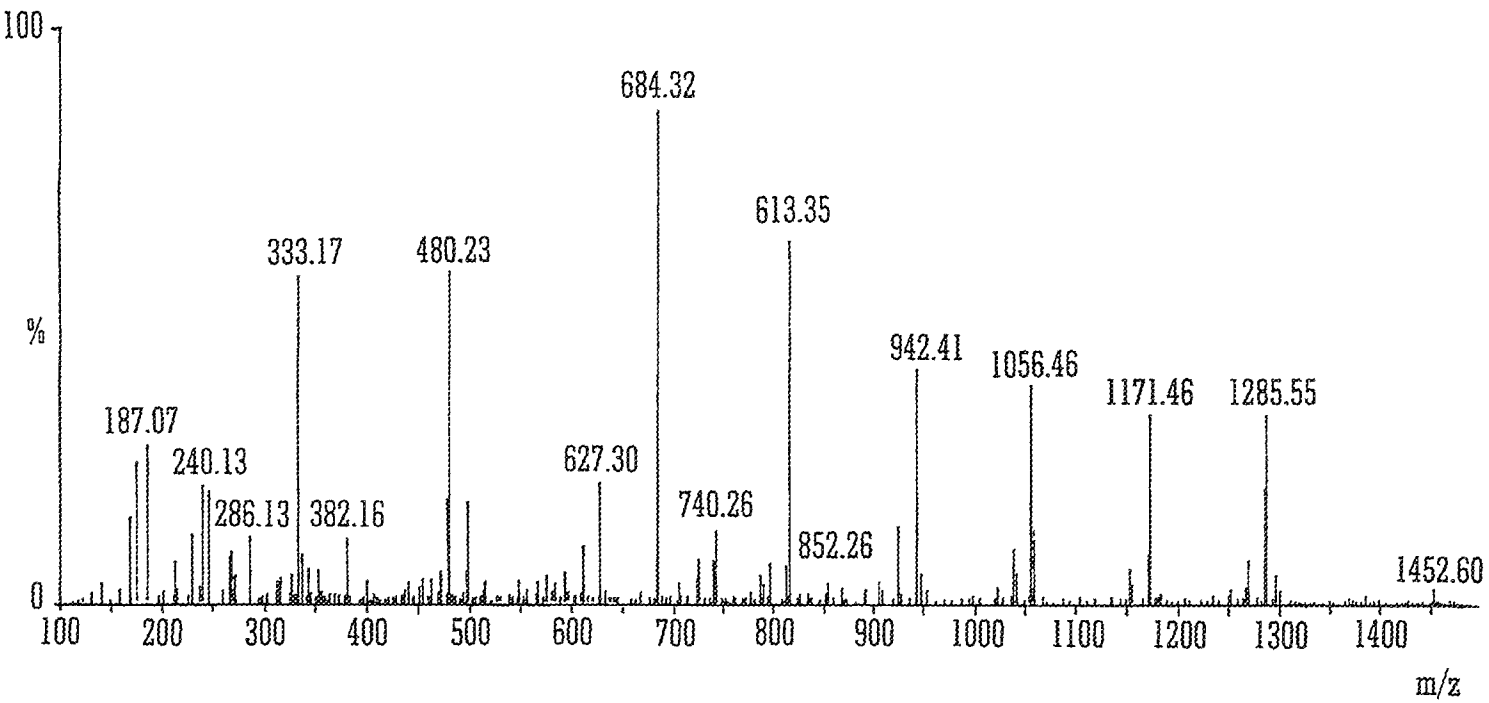
FIG. 7A shows a mass spectrum which was obtained using an arrangement as shown in FIG. 4 but wherein ions were not axially confined within the ion guide and FIG. 7B shows a mass spectrum which was obtained using a mass spectrometer as shown in FIG. 4 and operated according to a preferred embodiment of the present invention.
Figure 7B:
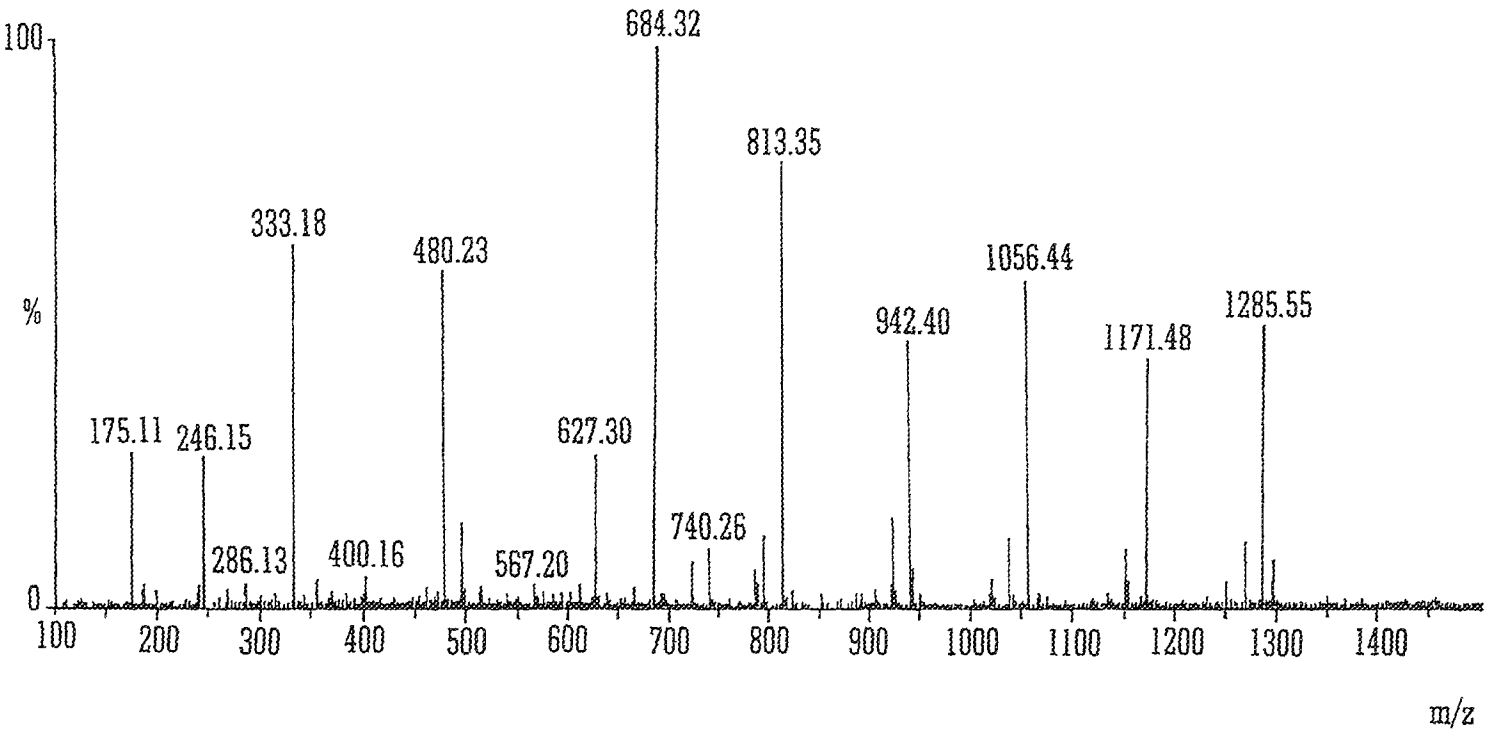

The low loss nature of the preferred device can be seen from comparing FIG. 7A with FIG. 7B. FIG. 7A is a mass spectrum which was obtained in a conventional manner. A mass spectrometer as shown in FIG. 4 was operated but the ion guide or ion trap 1 was operated as an ion guide only i.e. ions were not trapped within the ion guide 1. The mass spectrum shown in FIG. 7A was obtained after 5 s of continuous operation. The gate electrode 4 and the entrance and exit electrodes 2,3 were set for best transmission. FIG. 7B shows a mass spectrum which was obtained by combining the mass spectral data from scans 60 to 140 of the experiment described with reference to FIGS. 5A-5D.

FIGS. 7A and 7B show that there is little sensitivity difference between the two modes of operation indicating that the preferred ion guide or ion trap 1 when operated according to the preferred embodiment exhibits minimal losses.

Figure 8:
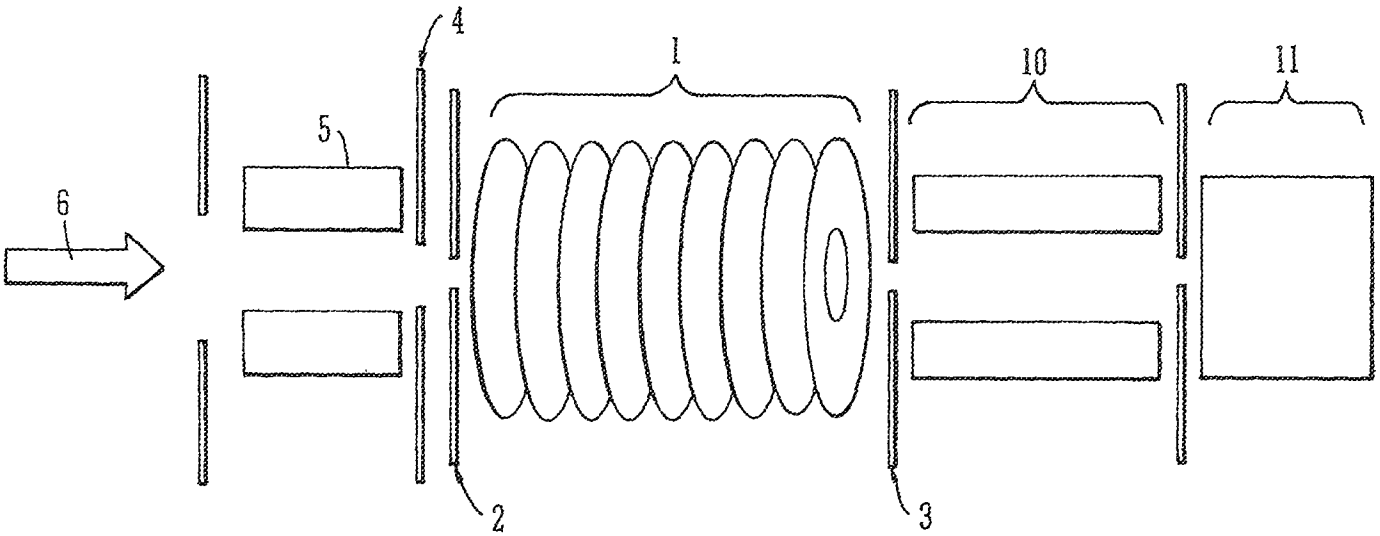
FIG. 8 shows an embodiment wherein a preferred ion guide or ion trap is provided upstream of a scanning quadrupole rod set mass analyser and ion detector.

FIG. 8 shows an embodiment wherein a scanning quadrupole rod set 10 is arranged downstream of a preferred ion guide or ion trap 1. The preferred ion guide or ion trap 1 may operate as a low to medium resolution mass separator or mass analyser. According to a preferred embodiment the preferred ion guide or ion trap 1 may be provided upstream of a higher resolution scanning/stepping device such as a quadrupole rod set. The combination of a low to medium resolution mass separator or mass analyser in series with a high resolution mass analyser allows a mass spectrometer to be provided having an improved overall instrument duty cycle and sensitivity. The output of the preferred ion guide or ion trap 1 is a function of mass to charge ratio and time. At any given time the mass to charge ratio range of ions exiting the preferred ion guide or ion trap 1 falls within a relatively narrow range. Alternatively, ions having a particular mass to charge ratio can be considered as exiting the preferred ion guide or ion trap 1 over a relatively narrow period of time.

If the mass to charge ratio transmission window of the scanning quadrupole 10 is linked in time with mass to charge ratio and time dependent output of the preferred ion guide or ion trap 1, then the duty cycle of the scanning quadrupole 10 is preferably increased.

Figure 9:
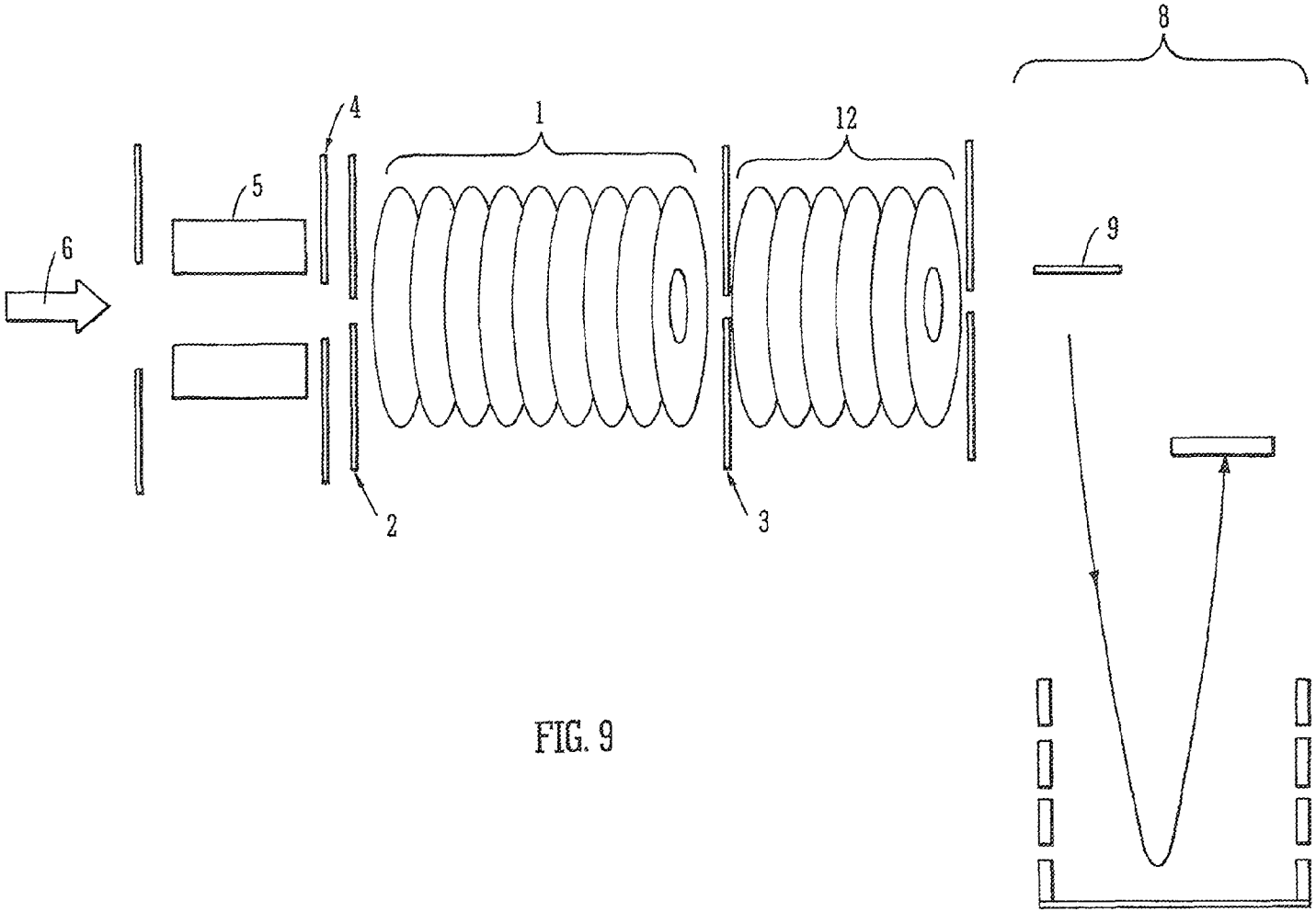
FIG. 9 shows another embodiment wherein a preferred ion guide or ion trap is provided upstream of a second ion guide and a Time of Flight mass analyser and wherein one or more transient DC voltages or transient DC voltage waveforms are applied to the electrodes of the second ion guide so that ions entering the second ion guide become trapped in axial potential wells which are translated along the length of the second ion guide.

FIG. 9 shows another embodiment wherein a preferred ion guide or ion trap 1 is provided upstream of an orthogonal acceleration Time of Flight mass analyser 8 and a second ion guide 12 is provided intermediate the preferred ion guide or ion trap 1 and the orthogonal acceleration Time of Flight mass analyser 8. One or more transient DC voltages or potentials or one or more transient DC voltage or potential waveforms are preferably applied to the electrodes of the second ion guide 12 so that a series of axial potential wells are preferably translated along the length of the second ion guide 12. According to this embodiment a mass spectrometer is provided which has an improved duty cycle and improved sensitivity. The output of the preferred ion guide or ion trap 1 is preferably mass to charge ratio dependent and time dependent.

The second ion guide 12 is preferably arranged to sample the output from the preferred ion guide or ion trap 1 and ions having a relatively narrow range of mass to charge ratios are preferably trapped in each packet of ions or potential well which is preferably transported or transmitted along the length of the second ion guide 12. Packets of ions or axial potential wells in which ions are trapped are preferably continually transported or translated along the length of the second ion guide 12 until substantially all ions have been released from the preferred ion guide or ion trap 1 and have preferably passed to the orthogonal acceleration Time of Flight mass analyser 8.

The orthogonal acceleration Time of Flight mass analyser preferably comprises an orthogonal acceleration electrode 9 for orthogonally accelerating ions into a drift or time of flight region. An orthogonal extraction pulse which is applied to the orthogonal acceleration electrode 9 is preferably arranged to be synchronised with the release of ions from an axial potential well of the second ion guide 12. The embodiment shown in FIG. 9 preferably maximises the transmission of ions from a given packet into the orthogonal acceleration Time of Flight mass analyser 8.

Although the present invention has been described with reference to preferred embodiments, it will be understood by those skilled in the art that various changes in form and detail may be made to the particular embodiments discussed above without departing from the scope of the invention as set forth in the accompanying claims.

We claim:

1. A method of mass spectrometry comprising:

providing a first ion guide or ion trap comprising one or more first electrodes and providing one or more exit electrodes downstream of said first electrodes;

trapping ions in a mode of operation within said ion guide or ion trap;

performing a plurality of cycles of operation, wherein each cycle of operation comprises the steps of: (i) enabling at least some ions to exit said ion guide or ion trap during a first time period $T_e$; and (ii) thereafter substantially preventing ions from exiting said ion guide or ion trap for a second time period $T_C$;

varying the length or width of said first time period $T_e$ in subsequent cycles of operation;

the method further comprising providing a quadrupole rod set mass filter/analyzer downstream of said ion guide or ion trap; wherein said quadrupole rod set mass filter/analyzer is scanned or stepped so as to mass filter/analyze ions that exit said ion guide or ion trap.

2. A method as claimed in claim 1, wherein an ion detector is provided downstream of said quadrupole rod set mass filter/analyzer for detecting ions transmitted by said quadrupole rod set mass filter/analyzer.

3. A method as claimed in claim 1, wherein the ion guide or ions trap operates as a lower resolution mass separator or mass analyzer and the quadrupole rod set mass filter/analyzer is operated as a higher resolution mass analyzer.

4. A method as claimed in claim 1, wherein the quadrupole rod set has a mass to charge ratio transmission window that is varied as the length or width of said first time period $T_e$ is varied.

5. A method as claimed in claim 1, further comprising substantially preventing ions from entering said ion guide or ion trap whilst said plurality of cycles of operation are being performed.

6. A method as claimed in claim 1, wherein said first electrodes comprise a plurality of electrodes having an aperture through which ions are transmitted in use.

7. A method as claimed in claim 1, further comprising applying a second AC or RF voltage to said one or more exit electrodes such that the potential of said one or more exit electrodes periodically drops below the average DC potential of said first electrodes.

8. A method as claimed in claim 7, wherein said step of varying the length or width of said first time period $T_e$ in subsequent cycles of operation comprises progressively decreasing, increasing, varying or scanning the frequency or amplitude of said second AC or RF voltage.

9. A method as claimed in claim 1, wherein in one of said cycles of operation the exit time $T_e$ is relatively short and only ions having a relatively low mass to charge ratio exit said ion guide or ion trap and in a subsequent one of said cycles of operation the exit time period $T_e$ is relatively long and only ions having a relatively high mass to charge ratio exit said ion guide or ion trap.

10. A method as claimed in claim 1, wherein said step of performing said plurality of cycles of operation comprises performing at least 5 of said cycles of operation and wherein said time period $T_e$ is progressively increased in said at least 5 cycles of operation.

11. A method as claimed in claim 1, wherein during said first time period $T_e$ ions are not resonantly ejected from said ion guide or ion trap.

12. A method of mass spectrometry comprising:

providing a first ion guide or ion trap comprising one or more first electrodes and providing one or more exit electrodes downstream of said first electrodes;

trapping ions in a mode of operation within said ion guide or ion trap;

performing a plurality of cycles of operation, wherein each cycle of operation comprises the steps of: (i) enabling at least some ions to exit said ion guide or ion trap during a first time period $T_e$; and (ii) thereafter substantially preventing ions from exiting said ion guide or ion trap for a second time period $T_C$;

varying the length or width of said first time period $T_e$ in subsequent cycles of operation; and providing a Time of Flight mass analyzer downstream of said ion guide or ion trap for mass analyzing ions that exit the ion guide or ion trap.

13. A method as claimed in claim 12, wherein said Time of Flight mass analyzer is an orthogonal acceleration Time of Flight mass analyzer.

14. A method as claimed in claim 12, further comprising providing a second ion guide or ion trap downstream of said first ion guide or ion trap, said second ion guide or ion trap comprising a plurality of electrodes.

15. A method as claimed in claim 14, further comprising applying one or more transient DC voltages or potentials or one or more transient DC voltage or potential waveforms to said plurality of electrodes comprising said second ion guide or ion trap.

16. A method as claimed in claim 15, further comprising translating a plurality of axial potential wells along the length of said second ion guide or ion trap.

17. A method as claimed in claim 16, wherein ions released from said first ion guide or ion trap are trapped in packets in said potential wells and transported along the length of the second ion guide or ion trap and released into the Time of Flight mass analyzer.

18. A method as claimed in claim 17, wherein extraction pulses of the Time of Flight mass analyzer are synchronized with the release of the packets of ions from the second ion guide or ion trap.

19. A method as claimed in claim 12, wherein the first ion guide or ions trap operates as a lower resolution mass separator or mass analyzer and the Time of Flight mass analyzer is operated as a higher resolution mass analyzer.

20. A method as claimed in claim 12, further comprising substantially preventing ions from entering said first ion guide or ion trap whilst said plurality of cycles of operation are being performed.

21. A method as claimed in claim 12, wherein in one of said cycles of operation the exit time $T_e$ is relatively short and only ions having a relatively low mass to charge ratio exit said ion guide or ion trap and in a subsequent one of said cycles of operation the exit time period $T_e$ is relatively long and only ions having a relatively high mass to charge ratio exit said ion guide or ion trap.

22. Apparatus comprising:

an ion guide or ion trap comprising one or more first electrodes;

one or more exit electrodes arranged downstream of said first electrodes; and a controller configured to trap ions in a mode of operation within said ion guide or ion trap and to perform a plurality of cycles of operation, wherein in each cycle of operation at least some ions are enabled to exit said ion guide or ion trap during a first time period $T_e$ and thereafter ions are substantially prevented from exiting said ion guide or ion trap for a second time period $T_c$;

wherein said controller is further arranged to vary the length or width of said first time period $T_e$ in subsequent cycles of operation;

said apparatus further comprising a quadrupole rod set mass filter/analyzer downstream of said ion guide or ion trap; wherein said quadrupole rod set mass filter/analyzer is configured to be scanned or stepped so as to mass filter/analyze ions that exit said ion guide or ion trap.

23. Apparatus comprising:

an ion guide or ion trap comprising one or more first electrodes;

one or more exit electrodes arranged downstream of said first electrodes; and a controller configured to trap ions in a mode of operation within said ion guide or ion trap and to perform a plurality of cycles of operation, wherein in each cycle of operation at least some ions are enabled to exit said ion guide or ion trap during a first time period $T_e$ and thereafter ions are substantially prevented from exiting said ion guide or ion trap for a second time period $T_c$;

wherein said controller is further arranged to vary the length or width of said first time period $T_e$ in subsequent cycles of operation;

said apparatus further comprising a Time of Flight mass analyzer downstream of said ion guide or ion trap for mass analyzing ions that exit the ion guide or ion trap.

* * * * *